US012195867B2

(12) United States Patent
Roh et al.

(10) Patent No.: US 12,195,867 B2
(45) Date of Patent: Jan. 14, 2025

(54) ELECTROCHEMICAL DEPOSITION SYSTEMS WITH ENHANCED CRYSTALLIZATION PREVENTION FEATURES

(71) Applicant: Applied Materials, Inc., Santa Clara, CA (US)

(72) Inventors: Kwan Wook Roh, Kalispell, MT (US); Xundong Dai, Singapore (SG); Keith Edward Ypma, Kalispell, MT (US); Scott A. Wehrmann, Columbia Falls, MT (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 17/538,245

(22) Filed: Nov. 30, 2021

(65) Prior Publication Data

US 2023/0167575 A1 Jun. 1, 2023

(51) Int. Cl.
*C25D 21/14* (2006.01)
*C25D 3/38* (2006.01)
(Continued)

(52) U.S. Cl.
CPC ..... *C25D 21/14* (2013.01); *C25D 3/38* (2013.01); *C25D 7/123* (2013.01); *C25D 17/001* (2013.01); *C25D 21/02* (2013.01)

(58) Field of Classification Search
CPC ..... C25D 7/12–123; C25D 17/001; C25D 3/38–40; H01L 21/2885; H01L 21/76873; H01L 2224/11462
See application file for complete search history.

(56) References Cited

U.S. PATENT DOCUMENTS 5,344,491 A 9/1994 Katou
2001/0052464 A1* 12/2001 Akram ..... C25F 7/00 205/137
(Continued)

FOREIGN PATENT DOCUMENTS

KR 101679351 B1 11/2016
TW 201710551 A 3/2017
(Continued)

OTHER PUBLICATIONS

McClurg, Using Power Sensors for Predictive Maintenance & Cost Savings, Pumps & Systems, accessed at https://www.pumpsandsystems.com/using-power-sensors-predictive-maintenance-cost-savings (Year: 2020).*
(Continued)

*Primary Examiner* — Hosung Chung
(74) *Attorney, Agent, or Firm* — Kilpatrick Townsend & Stockton LLP

(57) ABSTRACT

Electrochemical deposition systems and methods are described that have enhanced crystallization prevention features. The systems may include a bath vessel operable to hold an electrochemical deposition fluid having a metal salt dissolved in water. The systems may also include sensors including a thermometer and concentration sensor operable to measure characteristics of the electrochemical deposition fluid. The systems further include a computer configured to perform operations that include receiving system data from the electrochemical system and generating a control signal to change a characteristic of the electrochemical deposition fluid to prevent crystallization of a metal salt in the fluid. The computer generates the control signal based on processing that may include comparing an actual metal salt concentration in the electrochemical deposition fluid to a theoretical solubility limit for the metal salt in the fluid.

7 Claims, 6 Drawing Sheets

(51) Int. Cl.

| | |
|---|---|
| ***C25D 7/12*** | (2006.01) |
| ***C25D 17/00*** | (2006.01) |
| ***C25D 21/02*** | (2006.01) |

(56) References Cited

U.S. PATENT DOCUMENTS

| | | | | |
|---|---|---|---|---|
| 2004/0089555 | A1* | 5/2004 | Sendai | H01L 21/67742 205/137 |
| 2005/0081744 | A1* | 4/2005 | Klocke | C25D 3/38 205/291 |
| 2006/0246690 | A1 | 11/2006 | Dordi et al. | |
| 2008/0135415 | A1* | 6/2008 | Han | C25D 5/10 205/123 |
| 2011/0083965 | A1 | 4/2011 | Reid et al. | |
| 2015/0315720 | A1* | 11/2015 | Mayer | C25D 21/18 204/232 |
| 2019/0294193 | A1* | 9/2019 | Steffes | H02J 3/28 |
| 2019/0309436 | A1* | 10/2019 | Shimoyama | C25D 17/001 |
| 2021/0180202 | A1* | 6/2021 | Yamakawa | B22F 1/00 |

FOREIGN PATENT DOCUMENTS

| | | | | |
|---|---|---|---|---|
| TW | 202014381 | A | 4/2020 | |
| WO | WO-2020029856 | A1 * | 2/2020 | C08L 23/0853 |

OTHER PUBLICATIONS

Application No. PCT/US2022/046593, International Search Report and Written Opinion, Mailed on Feb. 14, 2023, 10 pages.

Office Action with accompanying English Machine Translation, issued on Nov. 17, 2023, in corresponding Taiwan Patent Application No. 111140021, 24 pages.

* cited by examiner

ELECTROCHEMICAL DEPOSITION SYSTEMS WITH ENHANCED CRYSTALLIZATION PREVENTION FEATURES

TECHNICAL FIELD

The present technology relates to systems, methods, and non-transitory computer-readable media to prevent the crystallization of metal salts in electrochemical deposition system. More specifically, the present technology relates to systems, methods, and non-transitory computer-readable media to monitor and adjust conditions in an electrochemical deposition fluid to prevent the crystallization of metal salts in the fluid.

BACKGROUND

Integrated circuits are made possible by processes that produce intricately patterned material layers on substrate surfaces. After formation, etching, and other processing on a substrate, metal or other conductive materials are often deposited or formed to provide the electrical connections between components. Because this metallization may be performed after many manufacturing operations, problems caused during the metallization may create expensive waste substrates or wafers.

Electroplating is performed in an electroplating chamber with the target side of the wafer in a bath of electrochemical deposition fluid, and with electrical contacts on a contact ring touching a conductive layer, such as a seed layer, on a substrate material. Electrical current is passed through the electrochemical deposition fluid and the conductive layer from a power supply. Metal ions from dissociated metal salts in the electrochemical deposition fluid plate out onto the substrate material, creating a metal layer on the substrate material. When the metal ions in the electrochemical deposition fluid are more concentrated, the plating rate of the metal layer is increased. However, increased concentrations of the metal salts that produce the metal ions also increase the probability that the electrochemical deposition fluid become oversaturated and the metal salts start to crystallize out of solution. The crystallized metal salts can irreversibly clog and jam the electrochemical deposition system. Thus, there is a need for improved systems and methods to prevent the crystallization of the metal salts in electrochemical deposition fluids. These and other needs are addressed by the present technology.

SUMMARY

Embodiments of the present technology include electrochemical deposition systems that include a bath vessel operable to hold an electrochemical deposition fluid having a metal salt dissolved in water. The systems also include a thermometer operable to measure a temperature of the electrochemical deposition fluid and a concentration sensor operable to measure a concentration of the metal salt in the electrochemical deposition fluid. The systems further include a computer configured to perform operations that include receiving system data from the electrochemical system, where the system data includes temperature data from the thermometer and metal salt concentration data from the concentration sensor. The computer operations also include generating from the system data an actual metal salt concentration in the electrochemical deposition fluid, and comparing the actual metal salt concentration to a theoretical solubility limit for the metal salt in the electrochemical deposition fluid. The computer operations further include generating a control signal to change the temperature of the electrochemical deposition fluid in the bath vessel, where the control signal depends on the comparison of the actual metal concentration to the theoretical solubility limit of the metal salt in the electrochemical deposition fluid.

In additional embodiments, the electrochemical deposition systems further include an acid concentration sensor operable to measure an acid concentration in the electrochemical deposition fluid, where the system data further includes acid concentration data from the acid concentration sensor. In further embodiments, the electrochemical deposition systems further include a level sensor operable to measure an amount of the electrochemical deposition fluid in the bath vessel, where the system data further includes electrochemical deposition fluid level data from the level sensor. In still further embodiments, the electrochemical deposition systems include a heater and pump that are operable to heat and circulate the electrochemical deposition fluid in the bath vessel, a first power sensor operable to sense if the heater is heating the electrochemical deposition fluid, and a second power sensor operable to sense if the pump is circulating the electrochemical deposition fluid. The first power sensor and the second power sensor are operable to provide system power data to the computer. In yet additional embodiments, the computer is configured to generate the control signal that further includes a drain signal to remove the electrochemical deposition fluid from the bath vessel based on the system power data. In more embodiments, the electrochemical deposition systems further include a source of deionized water operable to be added to the bath vessel to reduce the actual metal salt concentration in the electrochemical deposition fluid, where the control signal generated by the computer is operable to add a portion of the source of the deionized water to the bath vessel to reduce the actual metal salt concentration in the electrochemical deposition fluid. In yet more embodiments, the computer determines the theoretical solubility limit for the metal salt in the electrochemical deposition fluid based on the temperature of the electrochemical deposition fluid and a solubility constant of the metal salt in water. In still more embodiments, the metal salt includes a copper salt, a nickel salt, or a gold salt.

Embodiments of the present technology also include methods to prevent precipitation of an electrodeposition salt in an electrochemical deposition system. The methods include measuring a temperature of an electrochemical deposition fluid in a bath vessel of the electrochemical deposition system. The methods also include measuring a metal salt concentration of a metal salt in the electrochemical deposition fluid. The methods further include generating system data from the electrochemical deposition system, where the system data includes temperature data from the measuring of the temperature of the electrochemical deposition fluid, and concentration data from the measuring of the metal salt concentration in the electrochemical deposition fluid. The methods still further include generating a control signal from a computer coupled to the electrochemical deposition system, where the control signal adjusts the concentration or the temperature of the metal salt in the electrochemical deposition fluid.

In additional embodiments, the control signal generated by the computer adjusts the temperature of the metal salt in the electrochemical deposition fluid by adjusting an amount of power delivered to a heater in thermal contact with the electrochemical deposition fluid. In further embodiments, the control signal adjusts the concentration of the metal salt in the electrochemical deposition fluid by adjusting a flow of deionized water supplied to the electrochemical deposition fluid. In still further embodiments, the electrochemical deposition fluid further includes an acid characterized by an acid concentration, where the system data further includes acid concentration data from measuring the acid concentration of the electrochemical deposition fluid. In yet additional embodiments, the methods include measuring a first power condition from a heater to heat the electrochemical deposition fluid in the bath vessel and measuring a second power condition from a pump to circulate the electrochemical deposition fluid in the bath vessel, where the control signal generated by the computer includes a drain signal to remove the electrochemical deposition fluid from the bath vessel based on the measurement of the first power condition and the second power condition. In more embodiments, the metal salt in the electrochemical deposition fluid includes a copper salt, a nickel salt, or a gold salt.

Embodiments of the present technology further include a non-transitory computer-readable medium which includes instructions that, when executed by one or more processors, cause the one or more processors to execute operations that include receiving temperature data from a temperature sensor in thermal contact with an electrochemical deposition fluid in a bath vessel of an electrochemical deposition system. The operations further include receiving metal salt concentration data from a concentration sensor operable to measure a metal salt concentration in the electrochemical deposition fluid. The operations also include generating system data from the electrochemical deposition system, where the system data includes the temperature data and the metal salt concentration data. The operations yet further include generating a control signal based on the system data to adjust the temperature or the concentration of the metal salt in the electrochemical deposition fluid.

In additional embodiments, the non-transitory computer-readable medium includes instructions that, when executed by one or more processors, cause the one or more processors to execute operations that further include receiving acid concentration data from an acid concentration sensor operable to measure an acid concentration in the electrochemical deposition fluid and generate the control signal based on additional system data that includes the acid concentration data. In further embodiments, the non-transitory computer-readable medium includes instructions that, when executed by one or more processors, cause the one or more processors to execute operations that also include receiving electrochemical deposition fluid level data from a level sensor operable to measure an amount of the electrochemical deposition fluid in the bath vessel and generate the control signal based on additional system data that include the electrochemical deposition fluid level data. In still further embodiments, the non-transitory computer-readable medium includes instructions that, when executed by one or more processors, cause the one or more processors to execute operations that additionally include receiving power status data from a first power sensor operable to detect if a heater is heating the electrochemical deposition fluid and a second power sensor operable to detect if a pump is circulating the electrochemical deposition fluid in the bath vessel, and generating the control signal that includes a drain signal based on the power status data. In yet additional embodiments, the non-transitory computer-readable medium includes instructions that, when executed by one or more processors, cause the one or more processors to execute operations that further include generating from the system data an actual metal salt concentration in the electrochemical deposition fluid and comparing the actual metal salt concentration to a theoretical solubility limit for the metal salt in the electrochemical deposition fluid. The control signal generated by the computer may be further based on the comparing of the actual metal salt concentration to the theoretical solubility for the metal salt. In more embodiments, the theoretical solubility limit is generated by the computer based on the temperature of the electrochemical deposition fluid and a solubility constant of the metal salt in water.

Embodiments of the present technology enhance the prevention of metal salts from crystallizing in an electrochemical deposition system that is used to electroplate metal layers in semiconductor fabrication processes. The enhanced crystallization prevention permits the present electrochemical deposition systems to operate with higher concentrations of the metal salts in the electrochemical deposition fluids. The higher concentrations of the metal salts can significantly increase deposition rates of the electroplated metal layers, which increases the efficiency of the electrochemical deposition systems in fabricating semiconductor components and devices. These and other embodiments, along with many of their advantages and features, are described in more detail in conjunction with the below description and attached figures.

BRIEF DESCRIPTION OF THE DRAWINGS

A further understanding of the nature and advantages of the disclosed embodiments may be realized by reference to the remaining portions of the specification and the drawings.

Figure 1:
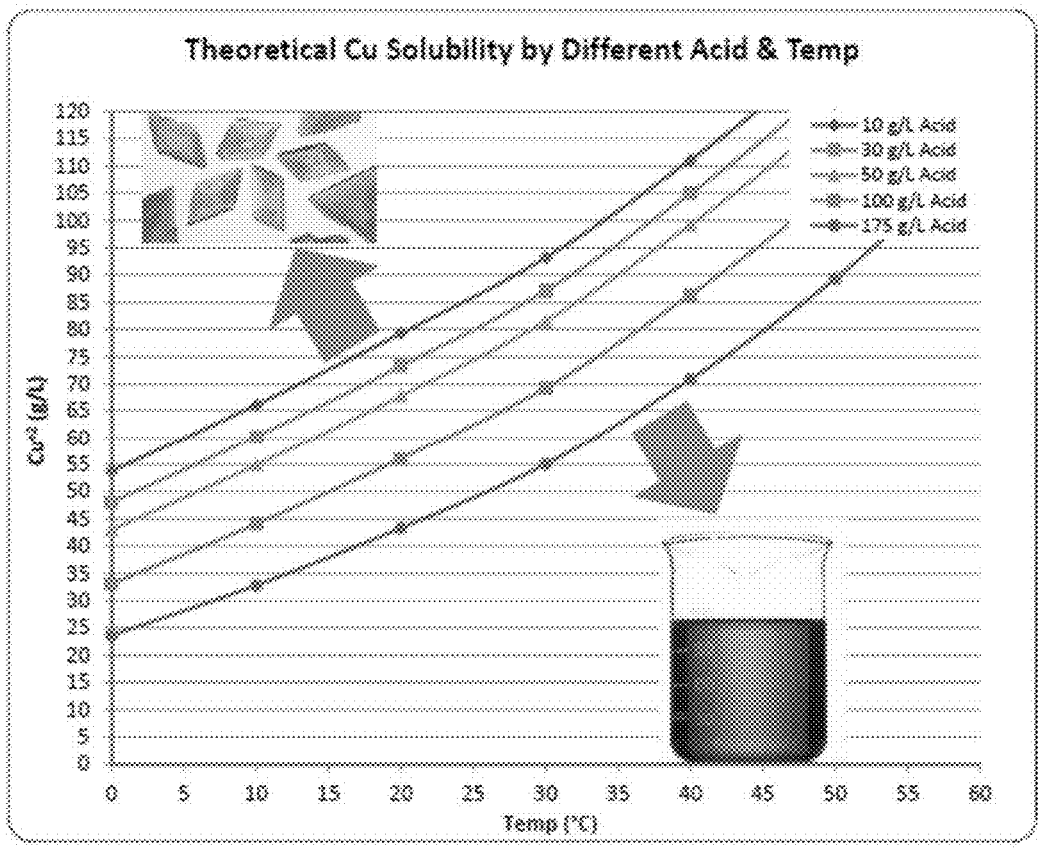
FIG. 1 shows theoretical solubility plots for an electrochemical deposition fluid that includes an aqueous solution of copper sulfate and sulfuric acid

Several of the figures are included as schematics. It is to be understood that the figures are for illustrative purposes and are not to be considered of scale unless specifically stated to be of scale. Additionally, as schematics, the figures are provided to aid comprehension and may not include all aspects or information compared to realistic representations and may include exaggerated material for illustrative purposes.

In the figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

Electrochemical deposition processes form metal interconnects in semiconductor devices with high efficiency. The electrochemical deposition rates of metals such as copper to form interconnects in semiconductor materials are often than two-to-three orders of magnitude faster than chemical and physical vapor deposition processes. The electrochemical deposition processes typically include contacting a target surface of a deposition substrate with an electrochemical deposition fluid held in a bath vessel of an electrochemical deposition system. A contact ring that includes electrical contacts are in contact with an electrically conductive material on the deposition substrate. When current is run through the electrical contacts, metal ions in the electrochemical deposition fluid are plated as a metal layer on the deposition substrate. In some embodiments, the deposited metal layer forms a metal interconnect without further processing. In additional embodiments, the deposited metal layer may be patterned, etched, and polished to form the metal interconnect on the deposition substrate.

The deposition rate of the metal layer on the deposition substrate is correlated with the concentration of the metal ions in the electrochemical deposition fluid. Fluids that are more concentrated in the metal ions deposit metal layers at faster deposition rates. In many embodiments, the electrochemical deposition fluid is an aqueous solution of a metal salt that is dissociated into the metal ions and a conjugate salt anion. In more embodiments, the conjugate salt anion is also the conjugate base anion of an acid present in the electrochemical deposition fluid to keep the metal ions dissolved in the aqueous solution. For example, an electrochemical deposition fluid for plating copper layers on deposition substrates may include a copper salt such as copper sulfate ($CuSO_4$) and an acid such as sulfuric acid ($H_2SO_4$) in a water solvent.

The solubility of the metal salt in the aqueous solution may depend on temperature of the solution and the concentration of the acid present. The temperature and acid concentration in the electrochemical deposition fluid can affect the solubility of the metal salt in opposite ways: when the temperature of the aqueous solution is increased the solubility of the metal salt in the aqueous solution is also increased. On the other hand, when concentration of the acid in the aqueous solution is increased, the solubility of the metal salt is decreased. In the case of an electrochemical deposition fluid that includes an aqueous copper sulfate solution, the solubility limit of the copper sulfate in water can be theoretically determined by Equation (I):

$$Cu = \frac{-a + \sqrt{a^2 - 4Ksp}}{2} \quad \text{(I)}$$

Where:

- Cu is the maximum molar weight of copper in the electrochemical deposition fluid;
- a is the molar weight of sulfuric acid ($H_2SO_4$) in the electrochemical deposition fluid; and
- $K_{sp}$ is the solubility product constant of copper sulfate ($CuSO_4$) in water, and changes with the temperature of the water.

Equation (I) can be used to plot theoretical solubility limits for copper sulfate in the electrochemical deposition fluid as a function of the temperature for incremental concentrations of sulfuric acid added to the deposition fluid. FIG. 1 shows plots of theoretical solubility limits for an aqueous copper sulfate and sulfuric acid containing electrochemical deposition fluid. The theoretical solubility limit curves include plots of the saturated molar weight concentration of copper ions ($Cu^{2+}$ (aq)) (in units of g/L) as a function of temperature (in units of ° C.) for a temperature range of about 0° C. to about 100° C. The theoretical solubility curves are plotted for several sulfuric acid concentrations ranging from about 10 g/L of $H_2SO_4$ (aq) to about 200 g/L of $H_2SO_4$ (aq). As shown in FIG. 1, each individual solubility curve shows increasing copper sulfate solubility limits as the temperature increases, and the collection of solubility curves show decreasing copper sulfate solubility limits at a given temperature with increasing concentrations of sulfuric acid.

The theoretical solubility limit curves may be used to determine how high a concentration of a metal salt can be used in the electrochemical deposition fluid. For many electrodeposition processes, increasing the concentration of the metal salt increases the deposition rate of the metal on the target substrate, which increases the efficiency of the deposition process. The theoretical solubility limit curves indicate how high the metal salt concentration can be before the electrochemical deposition fluid becomes oversaturated and starts to precipitate the metal salt out of the fluid.

For several reasons, the actual metal salt concentration in the electrochemical deposition fluid is set below the saturation limit indicated by the theoretical solubility limit for the metal salt. The electrochemical deposition fluid is subject to several conditions that can vary significantly during the plating of a metal layer on a target substrate, including localized temperature variations in the deposition fluid, as well as evaporation of solvent (e.g., water) from the fluid. In some instances, these variable conditions can create localized portions of the electrochemical deposition fluid that are oversaturated with the metal salt causing the salt to precipitate. In additional instances, such as the failure of a fluid heater or pump, or rapid evaporation of solvent across the whole surface area of the fluid, the whole volume of the fluid becomes oversaturated in the metal salt and causes metal salt precipitation throughout the deposition fluid in the bath vessel. The precipitated metal salts can clog the electrochemical deposition system and create a slowdown or outright stoppage of the plating of the metal layer on the target substrate. In some instances, the electrochemical deposition fluid is drained and the system is cleaned, resulting in significant downtime. In additional instances, the metal salt irreversibly precipitates and permanently clogs and jams components in the electrochemical deposition system, requiring them to be replaced. For these reasons and others, the actual concentration of a metal salt in the electrochemical deposition fluid is set at less than or about 90% of the theoretical solubility limit, less than or about 85% of the theoretical solubility limit, less than or about 80% of the theoretical solubility limit, less than or about 75% of the theoretical solubility limit, less than or about 70% of the theoretical solubility limit, less than or about 65% of the theoretical solubility limit, less than or about 60% of the theoretical solubility limit, less than or about 55% of the theoretical solubility limit, less than or about 50% of the theoretical solubility limit, or less.

Embodiments of the present technology include electrochemical deposition methods that permit electrochemical deposition systems to run at higher metal salt concentrations without an increased risk of metal salt precipitation. The ability to operate the electrochemical deposition system at a higher concentration of metal salt in the electrochemical deposition fluid permits the faster plating of metal on a target substrate. In embodiments, the electrochemical deposition systems include one or more sensors to measure a characteristic of the electrochemical deposition fluid that affects the solubility of one or more metal salts dissolved in the fluid. In further embodiments, the sensors may include a thermometer to measure the temperature of the electrochemical deposition fluid held in the bath vessel of electrochemical deposition system. In still further embodiments, the sensors include one or more concentration sensors operable to measure the concentration of one or more components of the electrochemical deposition fluid. In embodiments, a first concentration sensor may be operable to measure the concentration of metal ions of the metal salt in the fluid. In more embodiments, a second concentration sensor may be present that is operable to measure an acid concentration of an acid that is included in the fluid. In still more embodiments, the sensors may include a level sensor that is operable to measure an amount of electrochemical deposition fluid held in the bath vessel of the electrochemical deposition system. In additional embodiments, the sensors may include one or more power sensors operable to sense whether a component of the electrochemical deposition system is operating. Embodiments may include a heater power sensor operable to sense if a heater is heating the electrochemical deposition fluid. Additional embodiments may include a pump power sensor operable to sense if a pump is circulating the electrochemical deposition fluid in the bath vessel.

Embodiments of the present technology collect the data from the one or more sensors and process it into system data that may be used by a computer processor to determine if one or more actions should be performed by the electrochemical deposition system to prevent the precipitation of a metal salt in the system's electrochemical deposition fluid. In embodiments, the computer processor may use the system data to generate an actual metal salt solubility level of the metal salt in the system's electrochemical deposition fluid. In further embodiments, the computer processor may compare the actual metal salt solubility level to a theoretical solubility level and determine if the concentration of the metal salt in the fluid should be adjusted. In further embodiments, when the computer processor determines that a concentration adjustment should be made, the processor generates a control signal to change one or more characteristics of the electrochemical deposition fluid, such as the fluid's temperature, fluid's circulation rate, and the amount of water present in the fluid, among other fluid characteristics. In still further embodiments, the computer processor may determine that plating operations should be stopped, and the electrochemical deposition fluid should be removed from the system. In these embodiments, the computer processor may generate a control signal that includes a drain signal that opens a drain in the bath vessel to remove the electrochemical deposition fluid from the system.

Embodiments of the present technology permit an electrochemical deposition system to operate at higher concentrations of one or more metal salts in electrochemical deposition fluid with lower probabilities that the fluid conditions will cause the concentrated metal salts to precipitate in the fluid. In embodiments, the electrochemical deposition system may operate with the electrochemical deposition fluid at higher temperatures and lower acid concentrations to permit higher concentrations of metal salts in the fluid. In further embodiments, the data collected by the one or more sensors that are generated and analyzed by the computer processor permits the electrochemical deposition system to operate with more concentrated metal salts in the electrochemical deposition fluid without continuous operator measurement and analysis of the fluid's metal salt solubility characteristics.

Figure 2:
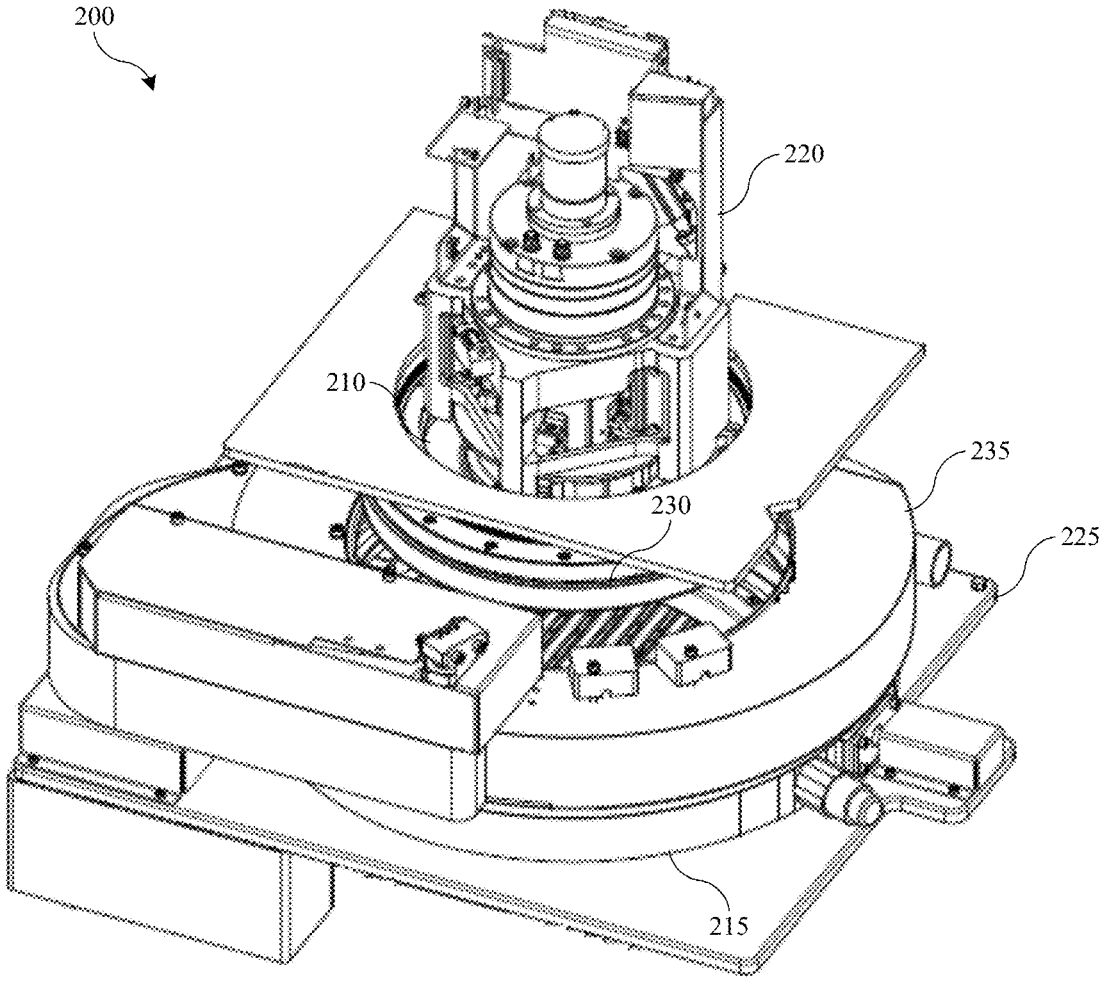
FIG. 2 shows a schematic perspective view of an electrochemical deposition system according to embodiments of the present technology.

FIG. 2 shows a schematic perspective view of an electroplating system 200 that can perform methods of preventing the crystallization of metal salts in the electrochemical deposition fluid according to embodiments of the present technology. Electroplating system 200 illustrates an exemplary electroplating system, including a system head 210 and a bath vessel 215. During electroplating operations, a wafer may be clamped to the system head 210, inverted, and extended into bath vessel 215 to perform an electroplating operation. Electroplating system 200 may include a head lifter 220, which may be configured to both raise and rotate the head 215, or otherwise position the head within the system, including tilting operations. The head and bath vessel may be attached to a deck plate 225 or other structure that may be part of a larger system incorporating multiple electroplating systems 200, and which may share electrochemical deposition fluid and other materials. A rotor may allow a substrate clamped to the head to be rotated within the bath vessel or outside the bath vessel in different operations. The rotor may include a contact ring, which may provide the conductive contact with the substrate. A seal 230 discussed further below may be connected with the head. Seal 230 may include a chucked wafer to be processed. FIG. 2 illustrates an electroplating system 200 that may include components to be cleaned directly on the platform. In embodiments, the electroplating system 200 further includes an in situ rinse system 235 for component cleaning. In additional embodiments (not shown) an electroplating system may be configured with a platform on which the head may be moved to an additional module where a seal or other component cleaning is performed.

Figure 3:
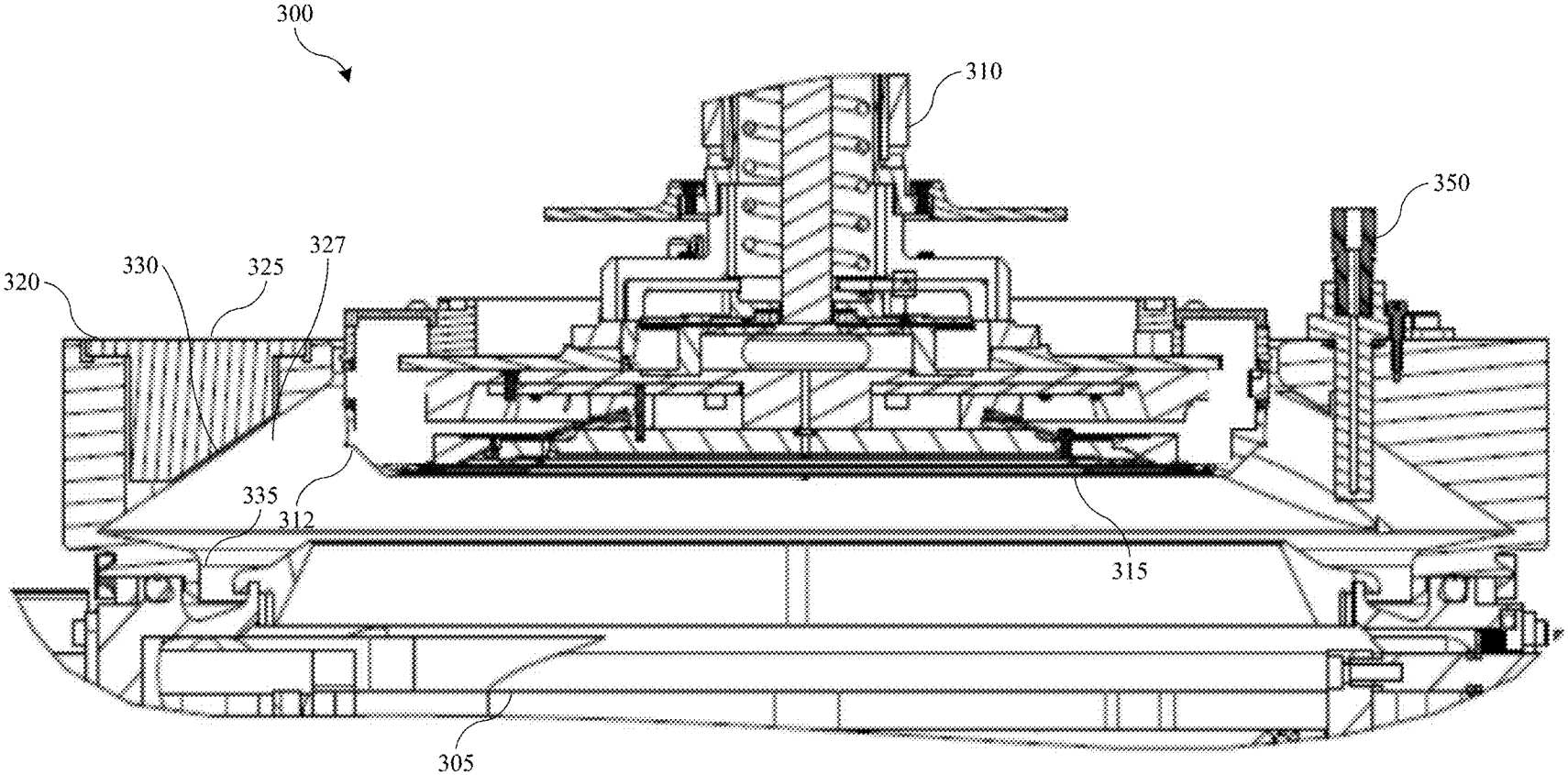
FIG. 3 shows a partial cross-sectional view of an electroplating system according to additional embodiments of the present technology.

FIG. 3 shows a partial cross-sectional view of another electrochemical deposition system 300 according to embodiments of the present technology. The system 300 includes a bath vessel 305 and a head 310 operable to have a substrate 315 coupled to the head. In the embodiment shown, a substrate is coupled with a seal 312 incorporated on the head 310. A rinsing frame 320 may be coupled above the bath vessel 305 and may be configured to receive the head 310 into the vessel during an electrochemical deposition operation. Rinsing frame 320 may include a rim 325 extending circumferentially about an upper surface of the bath vessel 305. A rinsing channel 327 may be defined between the rim 325 and an upper surface of the bath vessel 305. For example, rim 325 may include interior sidewalls 330 characterized by a sloping profile. As described above, rinse fluid slung off a substrate may contact the sidewalls 330 and may be received in a plenum 335 extending about the rim for collection of the rinse fluid from the electroplating apparatus 300.

In embodiments, electrochemical deposition system 300 may additionally include one or more cleaning components. The cleaning components may include one or more nozzles used to deliver fluids to or towards the substrate 315 or the head 310. FIG. 3 illustrates one of a variety of embodiments in which improved rinse assemblies may be used to protect the bath vessel and substrate during rinsing operations. In additional embodiments, a side clean nozzle 350 may extend through the rim 325 of the rinsing frame 320 and be directed to rinse seal 312, along with aspects of substrate 315.

In embodiments, system 200 and 300 may each further include one or more sensors (not shown) operable to measure one or more characteristics of an electrochemical deposition fluid in bath vessel 215 and 305, respectively. In further embodiments, the one or more sensors may include sensors a thermometer to measure the temperature of the electrochemical deposition fluid held in the bath vessel of electrochemical deposition system. In still further embodiments, the sensors may include one or more concentration sensors operable to measure the concentration of one or more components of the electrochemical deposition fluid, such as a metal ion concentration, and an acid concentration, among other components of the fluid. In still more embodiments, the sensors may include a level sensor that is operable to measure an amount of electrochemical deposition fluid held in the bath vessel of the electrochemical deposition system. In embodiments, data from the level sensor may be processed to determine a percentage of water in the electrochemical deposition fluid. In additional embodiments, system 200 and 300 may each further include one or more operational sensors (not shown) operable to measure the operational condition of a component of the system. In embodiments, the operational sensors may include one or more power sensors operable to sense whether a component of the electrochemical deposition system is operating. Embodiments may include a heater power sensor operable to sense if a heater is heating the electrochemical deposition fluid. Additional embodiments may include a pump power sensor operable to sense if a pump is circulating the electrochemical deposition fluid in the bath vessel. In still further embodiments, the system 200 and 300 may each include a drain sensor (not shown) to indicate whether a drain valve (not shown) fluidly connected to the bath vessel is in an open or closed state.

In more embodiments, the one or more sensors in system 200 and 300 may be in electronic communication with a computer (not shown) that receives system data from the sensors. In additional embodiments, the one or more sensors may be in continuous communication with the computer while the electrochemical deposition system includes an electrochemical deposition fluid that can become oversaturated with a metal salt at ambient conditions (e.g., room temperature fluid). In further embodiments, one or more of the sensors may be in communication with the computer at intervals when the sensor has new system data to provide the computer.

In additional embodiments, the computer may be operable to process the system data and provide a control signal to the electrochemical deposition system to adjust a solubility characteristic or quantity of electrochemical deposition fluid held in the system. In embodiments, the control signal may include a temperature signal with instructions to adjust the temperature of a heater (not shown) in the bath vessel of the electrochemical deposition system. In more embodiments, the control signal may include a dilution signal with instructions to adjust an amount of water (e.g., deionized water) provided to the bath vessel from a water supply in fluid communication with the bath vessel. In yet more embodiments, the control signal may include a drain signal with instructions to adjust the opening of a drain valve in fluid communication with the bath vessel.

Figure 4:
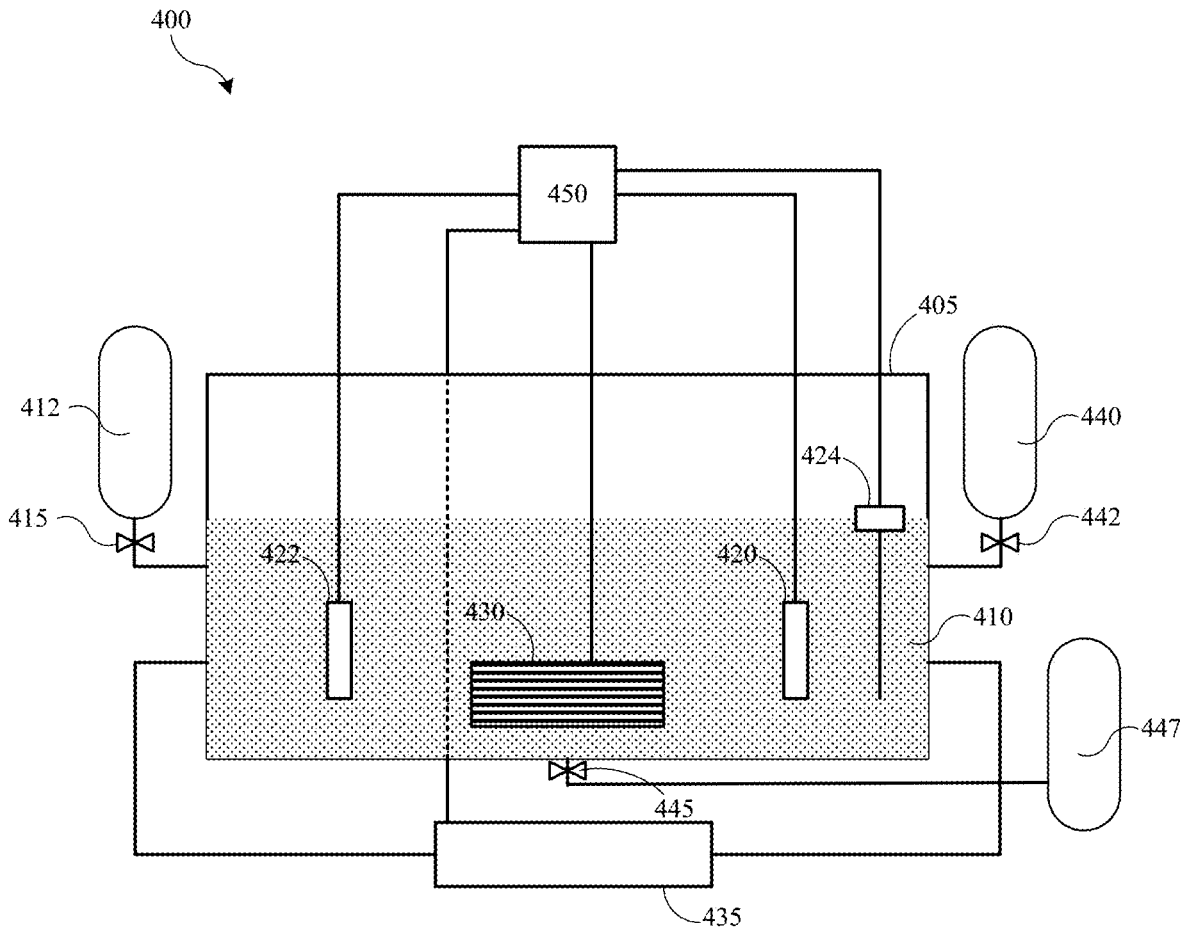
FIG. 4 shows a schematic perspective view of an electrochemical deposition system according to further embodiments of the present technology.
Figure 5:
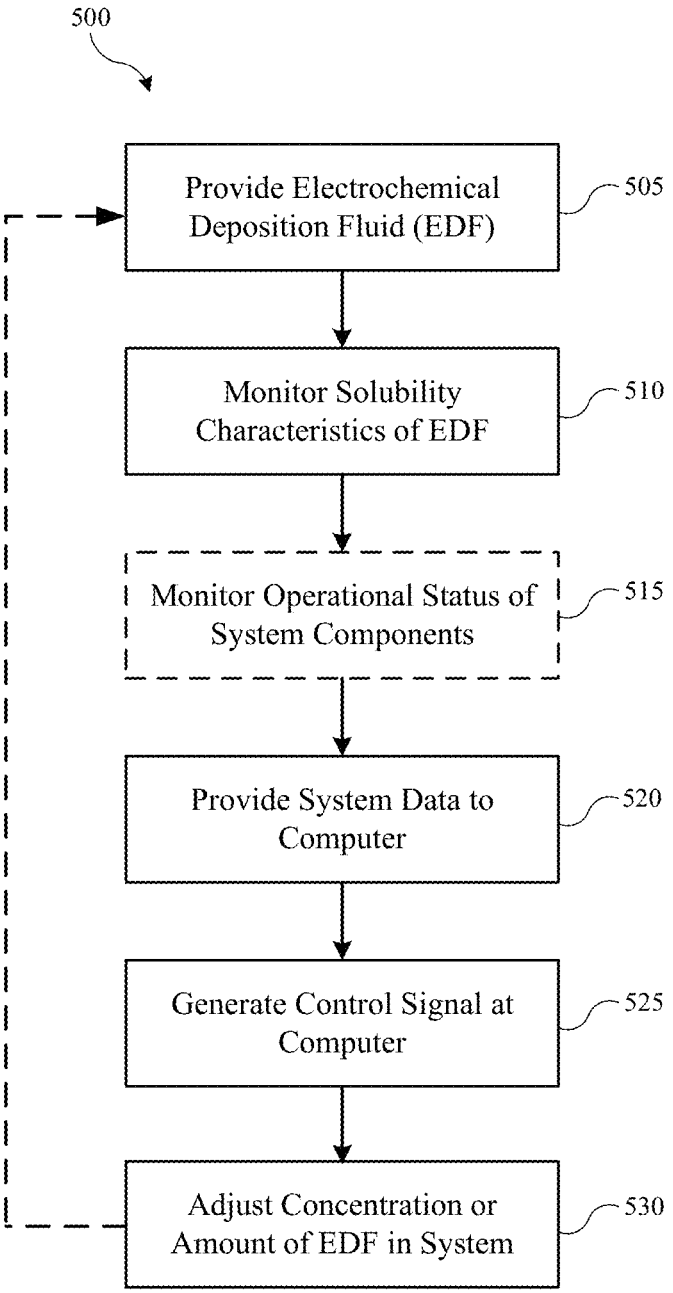
FIG. 5 shows another flowchart with selected operations in a method of preventing the crystallization of an electrodeposition salt in an electrochemical deposition system according to embodiments of the present technology.

Referring to FIG. 4 and FIG. 5, an embodiment of an electrochemical deposition system 400 and method 500, respectively, according to embodiments of the present technology are shown. The selected operations of method 500 to prevent the crystallization of an electrodeposition salt shown in FIG. 5 shall be described with reference to electrochemical deposition system 400 shown in FIG. 4. However, it will be appreciated that method 500, along with other embodiments of the methods of the present technology, may be implemented on additional embodiments of the present systems, including systems 200 and 300 illustrated in FIG. 2 and FIG. 3 above. It is also to be understood that the figures illustrate only partial schematic views, and the present electrochemical deposition systems may contain any number of additional components and features having a variety of characteristics and aspects, as illustrated in the figures. Embodiments of method 500 may or may not involve optional operations to develop a semiconductor structure to a particular fabrication operation.

FIG. 5 shows exemplary operations in a method 500 of preventing the crystallization of an electrodeposition salt in an electrochemical deposition system according to embodiments of the present technology. The method 500 may also include one or more operations prior to the initiation of the method, including front-end processing, deposition, gate formation, etching, polishing, cleaning, or any other operations that may be performed prior to the described operations. The method may further include a number of optional operations, which may or may not be specifically associated with some embodiments of methods according to the present technology. For example, many of the operations are described in order to provide a broader scope of the processes performed but are not critical to the technology or may be performed by alternative methodology, as will be discussed further below.

Method 500 may include providing an electrochemical deposition fluid to an electrochemical deposition system 400 at operation 505. In additional embodiments, the electrochemical deposition fluid 410 may be provided to bath vessel 405 from electrochemical deposition fluid supply 412. In further embodiments, the flow of fluid from the fluid supply 412 and the bath vessel 405 may be controlled by valve 415. In still further embodiments, valve 415 may be in electronic communication with computer 450, and the computer may be operable to generate a control signal that includes a fill signal with instructions to open the valve so electrochemical deposition fluid can flow to the bath vessel 405. The computer 450 may also be operable to generate a control signal that includes a stop signal that closes the valve 415 and stops the flow of fluid from the fluid supply 412 to the bath vessel 405. In embodiments, the computer 450 is operable to control the providing of electrochemical deposition fluid 410 to an empty bath vessel 405 at the start of an electrochemical deposition process, and further operation to control the addition of more electrochemical deposition fluid 410 during the process. Among other benefits, this reduces or eliminates operator attention to filling and monitoring the electrochemical deposition fluid 410 in the bath vessel 405 of the system 400.

In additional embodiments, the bath vessel 405 may be filled with a target amount of electrochemical deposition fluid 410 during an electrochemical deposition operation. In further embodiments, the target amount of electrochemical deposition fluid 410 may be input into the computer 450, and the computer will fill the bath vessel 405 with the inputted amount of electrochemical deposition fluid by sending control signals to valve 415. In some embodiments, the computer 450 may close valve 415 based on system data from system sensors that include a fluid flow monitor operation to monitor the amount of electrochemical deposition fluid 410 transported from the fluid supply 412 to the bath vessel 405. In additional embodiments, the computer may close valve 415 based on system data that include level data from a level sensor measuring the level of electrochemical deposition fluid 410 in the bath vessel 405.

In further embodiments, the electrochemical deposition fluid may include an aqueous solution of at least one metal salt that dissociates to produce metal ions. The metal ions are reduced on a target substrate (not shown) loaded into the electrochemical deposition system 400 and in contact with the electrochemical deposition fluid. In more embodiments, the metal ions may include one or more type of metal ions selected from copper ions, nickel ions, and gold ions, among other types of metal ions that can be reduced to form metal layers on the target substrate. In still more embodiments, the metal salts that dissociate into the metal ions may include copper salts, nickel salts, and gold salts, among other kinds of metal salts. In additional embodiments, the copper salts may include copper sulfate ($CuSO_4$), and/or copper methanesulfonate ($C_2H_6CuO_6S_2$) among other copper salts. In further embodiments, the nickel salts may include nickel sulfate ($NiSO_4$), nickel bromide ($NiBr_2$), and nickel chloride ($NiCl_2$), among other nickel salts. In still further embodiments, the gold salts may include gold sulfite, gold chloride, and gold cyanide, among other gold salts.

In additional embodiments, the electrochemical deposition fluid may further include at least one acid to facilitate the metal salt's dissociation in the aqueous solution. In embodiments, the acid may include a strong inorganic acid. In further embodiments, the strong inorganic acid may at least one of sulfuric acid ($H_2SO_4$), hydrochloric acid (HCl), and methanesulfonic acid ($CH_4O_3S$), among other kinds of strong inorganic acids. In more embodiments, the concentration of the acid in the electrochemical deposition fluid may depend on the concentration of the metal salt in the fluid. In embodiments, the acid concentration in the electrochemical deposition fluid may be less than or about 200 g/L, less than or about 175 g/L, less than or about 150 g/L, less than or about 125 g/L, less than or about 100 g/L, less than or about 90 g/L, less than or about 80 g/L, less than or about 70 g/L, less than or about 60 g/L, less than or about 50 g/L, less than or about 40 g/L, less than or about 30 g/L, less than or about 20 g/L, less than or about 10 g/L, or less.

Method 500 may further include monitoring the actual solubility level of one or more metal salts in the electrochemical deposition fluid 410 at operation 510. In embodiments, the monitoring may include measuring solubility characteristics of the electrochemical deposition fluid 410 with one or more sensors included in system 400. In further embodiments, the one or more sensors may include a temperature sensor 420 (e.g., a thermometer) in thermal contact with the electrochemical deposition fluid 410 in the bath vessel 405. In more embodiments, the one or more sensors may include at least one concentration sensor 422 operable to measure the concentration of one or more components of the electrochemical deposition fluid 410. In embodiments, the one or more measured components may include one or more metal salts or metal ions from the dissociated metal salts in the aqueous solution of the electrochemical deposition fluid 410. In more embodiments, the one or more measured components may include an acid dissolved in the electrochemical deposition fluid 410. In additional embodiments, the one or more sensors may include a level sensor 424 that is operable to measure an amount of electrochemical deposition fluid 410 present in the bath vessel 405. As water evaporates from the electrochemical deposition fluid 410, the metals salts and other non-aqueous components of the fluid can become more concentrated. The level sensor 424 can provide level sensor data that can be processed to determine changes in the metal salt concentration due to evaporation of water from the electrochemical deposition fluid 410.

Method 500 may also optionally include monitoring the operational status of one or more system components at operation 515. In embodiments, the one or more system components may include a heater 430 that is operable to heat the electrochemical deposition fluid 410 in the bath vessel 405. In further embodiments, the one or more system components may include a pump 435 that is operable to circulate the electrochemical deposition fluid 410 in the bath vessel 405. In still further embodiments, the monitoring may include receiving and analyzing system data from one or more power sensors (not shown) in electronic communication with the one or more system components. The system data may include an operational status of the one or more system components, such as whether the component is powered and running.

Method 500 may further include providing system data to a computer at operation 520. In the embodiment shown in system 400, the system data collected from thermometer 420, at least one concentration sensor 422, level sensor 424, and power sensors (not shown) in electronic communication with heater 430 and pump 435, may be provided to computer 450. In embodiments, at least one of the sensors may be physically wired to the computer 450 to provide at least part of the system data to the computer. In additional embodiments, at least one of the sensors may be in wireless communication with the computer 450 to provide at least part of the system data to the computer.

Method 500 may still also include generating a control signal at the computer in operation 525. In embodiments, the control signal may be generated by the computer 450 based on the processing of system data received at operation 520. In further embodiments, the processing of the system data may include the computer 450 comparing an actual metal salt concentration in the electrochemical deposition fluid 410 to a theoretical solubility limit of the metal salt in the deposition fluid. In more embodiments, if the actual metal salt concentration is within a percentage of the theoretical solubility limit, the computer 450 generates a control signal with instructions for the system 400 to lower the concentration of the metal salt in the electrochemical deposition fluid 410. In embodiments, this control signal may be generated when the difference between the actual metal salt concentration and the theoretical solubility limit is less than or about 20%, less than or about 15%, less than or about 10%, less than or about 9%, less than or about 8%, less than or about 7%, less than or about 6%, less than or about 5%, less than or about 4%, less than or about 3%, less than or about 2%, less than or about 1%, or less. In further embodiments, a threshold percentage difference between the actual metal salt concentration and the theoretical solubility limit may be input to the computer 450 to trigger the generation of the control signal. When the computer 450 determines that the percentage different is less than or about the inputted threshold percentage difference, it generates the control signal.

In additional embodiments, the computer 450 may determine the actual metal salt concentration in the electrochemical deposition fluid 410 using one or more pieces of the system data. In embodiments, the system data used by the computer 450 to determine the actual metal salt concentration may include metal salt concentration data from a concentration sensor 422 measuring the electrochemical deposition fluid 410. In further embodiments, the system data used by the computer 450 to determine the actual metal salt concentration may include level data from the level sensor 424 measuring the amount of electrochemical deposition fluid 410 present in the bath vessel 405.

In additional embodiments, the computer 450 may also determine the theoretical solubility limit of the metal salt in the electrochemical deposition fluid 410 using one or more pieces of the system data. In embodiments, the system data used by the computer 450 to determine the theoretical solubility limit of the metal salt in the electrochemical deposition fluid 410 may include temperature data from a temperature sensor 420 in thermal contact with the electrochemical deposition fluid 410. In more embodiments, the system data may include acid concentration data from a concentration sensor (e.g., concentration sensor 422 in some embodiments). In still further embodiments, the acid concentration data may include pH data on the electrochemical deposition fluid 410. In yet still further embodiments, the acid concentration data may include concentration data on a dissociated anion formed in the aqueous solution of the electrochemical deposition fluid 410. In yet additional embodiments, the system data may include metal salt concentration data from a concentration sensor 422. In yet more embodiments, the system data may include level data from the level sensor 424. In embodiments, the computer 450 may use the system data for inputs into an equation for determining the theoretical solubility limit of the metal salt in the current conditions of the electrochemical deposition fluid 410. In further embodiments, when the metal salt is copper sulfate, the equation the computer uses may include Equation (I) above.

Method 500 may yet further include adjusting a metal salt concentration in the electrochemical deposition fluid 410, or the amount of electrochemical deposition fluid 410 in the bath vessel 405, at operation 530. In embodiments, the adjustment may include sending the control signal generated by the computer 450 in operation 525 to the system 400. In further embodiments, the control signal may include instructions to adjust the power supplied to the heater 430 in order to adjust the temperature of the electrochemical deposition fluid 410 in bath vessel 405. In more embodiments, the control signal may include instructions to increase an amount of deionized water added to the electrochemical deposition fluid 410 from deionized water supply 440. In yet more embodiments, the instructions may include instructions to open valve 442 to increase a flow of deionized water from the deionized water supply 440 to the bath vessel 405.

In additional embodiments, the adjustment in the amount of electrochemical deposition fluid 410 in the bath vessel 405 may include draining substantially all the deposition fluid from the bath vessel. In embodiments, the computer 450 may receive power system data from one or more sensors in electronic communication with a component of the system 400 that indicate the component is no longer operating. In additional embodiments, the power system data may include power data from a sensor in electronic communication with heater 430. In still additional embodiments, the power system data may include power data from a sensor in electronic communication with pump 435. In embodiments, the computer 450 may process this data and generate a control signal that includes a drain signal with instructions to open a drain valve 445 in order to drain the electrochemical deposition fluid 410 from the bath vessel 405 to a drain reservoir 447.

In further embodiments, the power system data may trigger the computer to check the actual metal salt concentration in the electrochemical deposition fluid 410 to determine if the concentration is in an acceptable range for performing electrochemical deposition operations. If the actual metal salt concentration is in an acceptable range, the computer 450 will not generate a control signal that includes a drain signal until the actual metal salt concentration exceeds the acceptable concentration range.

In additional embodiments, that adjustment to the metal salt concentration in operation 530 may include increasing the metal salt concentration in the electrochemical deposition fluid 410. In embodiments, the computer 450 may generate a control signal that includes adding more of the electrochemical deposition fluid from electrochemical deposition fluid supply 412 to the bath vessel 405. In additional embodiments, the computer 450 may generate a control signal that includes increasing the power to the heater 430 in order to evaporate more water from the electrochemical deposition fluid 410 in the bath vessel 405. In these embodiments, the control signal may include instructions to increase the power to the heater 430 until the level sensor 424 measures a reduced amount of electrochemical deposition fluid 410 in the bath vessel 405.

Embodiments of the present technology permit electrochemical deposition systems to perform electrochemical deposition operations at increased metal salt concentrations in the electrochemical deposition fluid used in the systems. In embodiments, the metal salt concentrations in the electrochemical deposition fluid may be greater than or about 10 g/L, greater than or about 20 g/L, greater than or about 30 g/L, greater than or about 40 g/L, greater than or about 50 g/L, greater than or about 60 g/L, greater than or about 70 g/L, greater than or about 80 g/L, greater than or about 90 g/L, greater than or about 100 g/L, greater than or about 110 g/L, greater than or about 120 g/L, greater than or about 130 g/L, greater than or about 140 g/L, greater than or about 150 g/L, greater than or about 160 g/L, greater than or about 170 g/L, greater than or about 180 g/L, greater than or about 190 g/L, greater than or about 200 g/L, or more. The ability of the systems to perform electrochemical deposition operations at these increased metal salt concentrations in the electrochemical deposition fluid increases the formation rates of electroplated metal layers on deposition substrates. This can increase the efficiency of the electrochemical deposition operations by greater than 10%, greater than 20%, greater than 30%, greater than 40%, greater than 50%, or more, compared to running the operations at conventional concentrations of the metal salts in the electrochemical deposition fluid.

Figure 6:
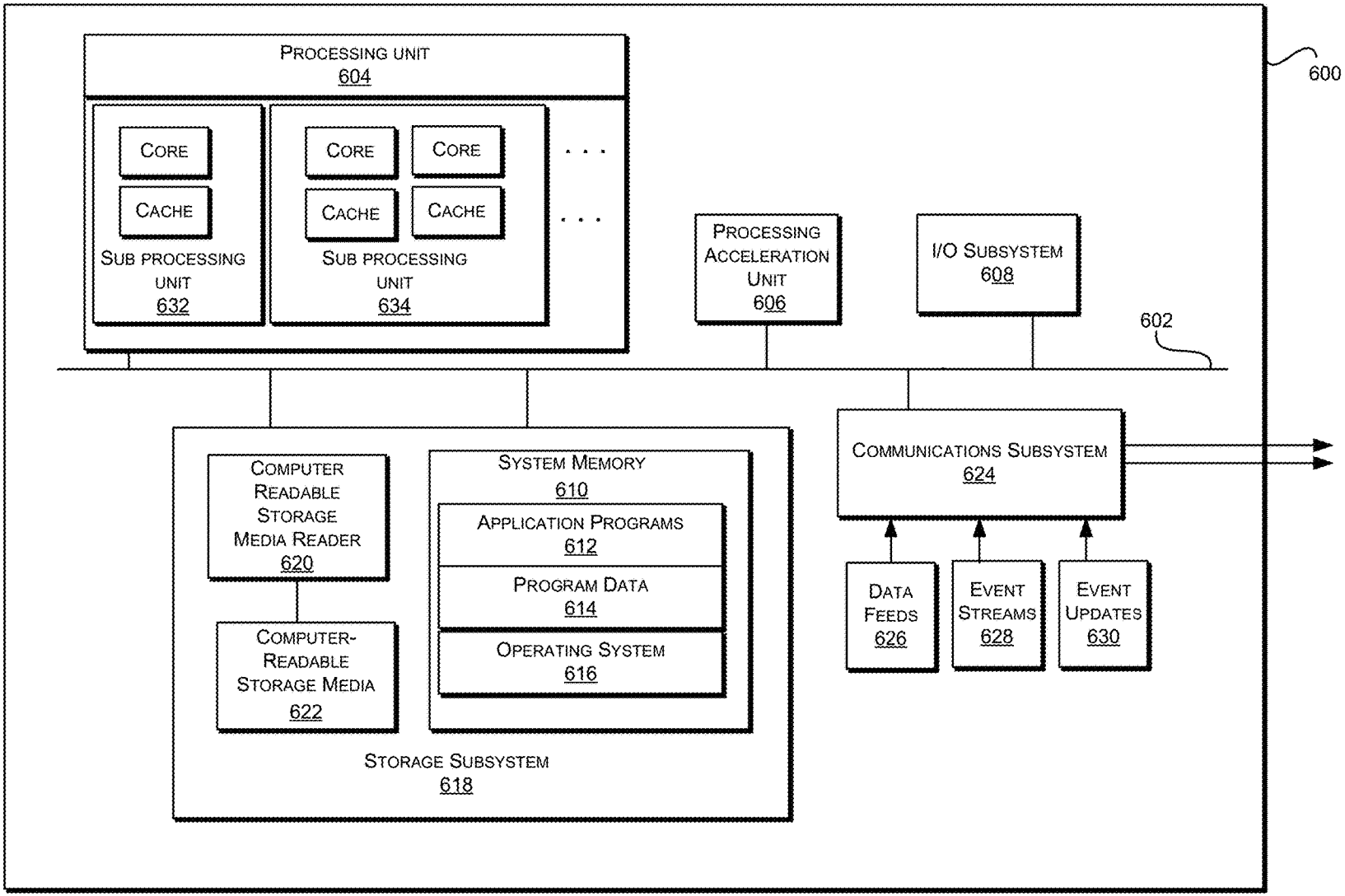
FIG. 6 shows an exemplary computer system, in which various embodiments may be implemented.

FIG. 6 illustrates a block diagram of components of a computer system 600 that may be included in embodiments of the present technology (e.g., computer 450 in system 400). As shown in the figure, computer system 600 includes a processing unit 604 that communicates with a number of peripheral subsystems via a bus subsystem 602. These peripheral subsystems may include a processing acceleration unit 606, an I/O subsystem 608, a storage subsystem 618 and a communications subsystem 624. Storage subsystem 618 includes tangible computer-readable storage media 622 and a system memory 610.

Bus subsystem 602 provides a mechanism for letting the various components and subsystems of computer system 600 communicate with each other as intended. Although bus subsystem 602 is shown schematically as a single bus, alternative embodiments of the bus subsystem may utilize multiple buses. Bus subsystem 602 may be any of several types of bus structures including a memory bus or memory controller, a peripheral bus, and a local bus using any of a variety of bus architectures. For example, such architectures may include an Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus, which can be implemented as a Mezzanine bus manufactured to the IEEE P1386.1 standard.

Processing unit 604, which can be implemented as one or more integrated circuits (e.g., a conventional microprocessor or microcontroller), controls the operation of computer system 600. One or more processors may be included in processing unit 604. These processors may include single core or multicore processors. In certain embodiments, processing unit 604 may be implemented as one or more independent processing units 632 and/or 634 with single or multicore processors included in each processing unit. In other embodiments, processing unit 604 may also be implemented as a quad-core processing unit formed by integrating two dual-core processors into a single chip.

In various embodiments, processing unit 604 can execute a variety of programs in response to program code and can maintain multiple concurrently executing programs or processes. At any given time, some or all of the program code to be executed can be resident in processor(s) 604 and/or in storage subsystem 618. Through suitable programming, processor(s) 604 can provide various functionalities described above. Computer system 600 may additionally include a processing acceleration unit 606, which can include a digital signal processor (DSP), a special-purpose processor, and/or the like.

I/O subsystem 608 may include user interface input devices and user interface output devices. User interface input devices may include a keyboard, pointing devices such as a mouse or trackball, a touchpad or touch screen incorporated into a display, a scroll wheel, a click wheel, a dial, a button, a switch, a keypad, audio input devices with voice command recognition systems, microphones, and other types of input devices. User interface input devices may include, for example, motion sensing and/or gesture recognition devices such as the Microsoft Kinect® motion sensor that enables users to control and interact with an input device, such as the Microsoft Xbox® 360 game controller, through a natural user interface using gestures and spoken commands. User interface input devices may also include eye gesture recognition devices such as the Google Glass® blink detector that detects eye activity (e.g., 'blinking' while taking pictures and/or making a menu selection) from users and transforms the eye gestures as input into an input device (e.g., Google Glass®). Additionally, user interface input devices may include voice recognition sensing devices that enable users to interact with voice recognition systems (e.g., Siri® navigator), through voice commands.

User interface input devices may also include, without limitation, three dimensional (3D) mice, joysticks or pointing sticks, gamepads and graphic tablets, and audio/visual devices such as speakers, digital cameras, digital camcorders, portable media players, webcams, image scanners, fingerprint scanners, barcode reader 3D scanners, 3D printers, laser rangefinders, and eye gaze tracking devices. Additionally, user interface input devices may include, for example, medical imaging input devices such as computed tomography, magnetic resonance imaging, position emission tomography, medical ultrasonography devices. User interface input devices may also include, for example, audio input devices such as MIDI keyboards, digital musical instruments and the like.

User interface output devices may include a display subsystem, indicator lights, or non-visual displays such as audio output devices, etc. The display subsystem may be a cathode ray tube (CRT), a flat-panel device, such as that using a liquid crystal display (LCD) or plasma display, a projection device, a touch screen, and the like. In general, use of the term "output device" is intended to include all possible types of devices and mechanisms for outputting information from computer system 600 to a user or other computer. For example, user interface output devices may include, without limitation, a variety of display devices that visually convey text, graphics and audio/video information such as monitors, printers, speakers, headphones, automotive navigation systems, plotters, voice output devices, and modems.

Computer system 600 may comprise a storage subsystem 618 that comprises software elements, shown as being currently located within a system memory 610. System memory 610 may store program instructions that are loadable and executable on processing unit 604, as well as data generated during the execution of these programs.

Depending on the configuration and type of computer system 600, system memory 610 may be volatile (such as random access memory (RAM)) and/or non-volatile (such as read-only memory (ROM), flash memory, etc.) The RAM typically contains data and/or program modules that are immediately accessible to and/or presently being operated and executed by processing unit 604. In some implementations, system memory 610 may include multiple different types of memory, such as static random access memory (SRAM) or dynamic random access memory (DRAM). In some implementations, a basic input/output system (BIOS), containing the basic routines that help to transfer information between elements within computer system 600, such as during start-up, may typically be stored in the ROM. By way of example, and not limitation, system memory 610 also illustrates application programs 612, which may include client applications, Web browsers, mid-tier applications, relational database management systems (RDBMS), etc., program data 614, and an operating system 616. By way of example, operating system 616 may include various versions of Microsoft Windows®, Apple Macintosh®, and/or Linux operating systems, a variety of commercially-available UNIX® or UNIX-like operating systems (including without limitation the variety of GNU/Linux operating systems, the Google Chrome® OS, and the like) and/or mobile operating systems such as iOS, Windows® Phone, Android® OS, BlackBerry® 10 OS, and Palm® OS operating systems.

Storage subsystem 618 may also provide a tangible computer-readable storage medium for storing the basic programming and data constructs that provide the functionality of some embodiments. Software (programs, code modules, instructions) that when executed by a processor provide the functionality described above may be stored in storage subsystem 618. These software modules or instructions may be executed by processing unit 604. Storage subsystem 618 may also provide a repository for storing data used in accordance with some embodiments.

Storage subsystem 600 may also include a computer-readable storage media reader 620 that can further be connected to computer-readable storage media 622. Together and, optionally, in combination with system memory 610, computer-readable storage media 622 may comprehensively represent remote, local, fixed, and/or removable storage devices plus storage media for temporarily and/or more permanently containing, storing, transmitting, and retrieving computer-readable information.

Computer-readable storage media 622 containing code, or portions of code, can also include any appropriate media, including storage media and communication media, such as but not limited to, volatile and non-volatile, removable and non-removable media implemented in any method or technology for storage and/or transmission of information. This can include tangible computer-readable storage media such as RAM, ROM, electronically erasable programmable ROM (EEPROM), flash memory or other memory technology, CD-ROM, digital versatile disk (DVD), or other optical storage, magnetic cassettes, magnetic tape, magnetic disk storage or other magnetic storage devices, or other tangible computer readable media. This can also include nontangible computer-readable media, such as data signals, data transmissions, or any other medium which can be used to transmit the desired information and which can be accessed by computing system 600.

By way of example, computer-readable storage media 622 may include a hard disk drive that reads from or writes to non-removable, nonvolatile magnetic media, a magnetic disk drive that reads from or writes to a removable, nonvolatile magnetic disk, and an optical disk drive that reads from or writes to a removable, nonvolatile optical disk such as a CD ROM, DVD, and Blu-Ray® disk, or other optical media. Computer-readable storage media 622 may include, but is not limited to, Zip® drives, flash memory cards, universal serial bus (USB) flash drives, secure digital (SD) cards, DVD disks, digital video tape, and the like. Computer-readable storage media 622 may also include, solid-state drives (SSD) based on non-volatile memory such as flash-memory based SSDs, enterprise flash drives, solid state ROM, and the like, SSDs based on volatile memory such as solid state RAM, dynamic RAM, static RAM, DRAM-based SSDs, magnetoresistive RAM (MRAM) SSDs, and hybrid SSDs that use a combination of DRAM and flash memory based SSDs. The disk drives and their associated computer-readable media may provide non-volatile storage of computer-readable instructions, data structures, program modules, and other data for computer system 600.

Communications subsystem 624 provides an interface to other computer systems and networks. Communications subsystem 624 serves as an interface for receiving data from and transmitting data to other systems from computer system 600. For example, communications subsystem 624 may enable computer system 600 to connect to one or more devices via the Internet. In some embodiments communications subsystem 624 can include radio frequency (RF) transceiver components for accessing wireless voice and/or data networks (e.g., using cellular telephone technology, advanced data network technology, such as 3G, 4G, 5G, or EDGE (enhanced data rates for global evolution), WiFi (IEEE 802.11 family standards, or other mobile communication technologies, or any combination thereof), global positioning system (GPS) receiver components, and/or other components. In some embodiments communications subsystem 624 can provide wired network connectivity (e.g., Ethernet) in addition to or instead of a wireless interface.

In some embodiments, communications subsystem 624 may also receive input communication in the form of structured and/or unstructured data feeds 626, event streams 628, event updates 630, and the like on behalf of one or more users who may use computer system 600.

By way of example, communications subsystem 624 may be configured to receive data feeds 626 in real-time from users of social networks and/or other communication services such as Twitter® feeds, Facebook® updates, web feeds such as Rich Site Summary (RSS) feeds, and/or real-time updates from one or more third party information sources.

Additionally, communications subsystem 624 may also be configured to receive data in the form of continuous data streams, which may include event streams 628 of real-time events and/or event updates 630, that may be continuous or unbounded in nature with no explicit end. Examples of applications that generate continuous data may include, for example, sensor data applications, financial tickers, network performance measuring tools (e.g. network monitoring and traffic management applications), clickstream analysis tools, automobile traffic monitoring, and the like.

Communications subsystem 624 may also be configured to output the structured and/or unstructured data feeds 626, event streams 628, event updates 630, and the like to one or more databases that may be in communication with one or more streaming data source computers coupled to computer system 600.

Computer system 600 can be one of various types, including a handheld portable device (e.g., an iPhone® cellular phone, an iPad® computing tablet, a PDA), a wearable device (e.g., a Google Glass® head mounted display), a PC, a workstation, a mainframe, a kiosk, a server rack, or any other data processing system.

Due to the ever-changing nature of computers and networks, the description of computer system 600 depicted in the figure is intended only as a specific example. Many other configurations having more or fewer components than the system depicted in the figure are possible. For example, customized hardware might also be used and/or particular elements might be implemented in hardware, firmware, software (including applets), or a combination. Further, connection to other computing devices, such as network input/output devices, may be employed. Based on the disclosure and teachings provided herein, other ways and/or methods to implement the various embodiments should be apparent.

In the foregoing description, for the purposes of explanation, numerous specific details were set forth in order to provide a thorough understanding of various embodiments. It will be apparent, however, that some embodiments may be practiced without some of these specific details. In other instances, well-known structures and devices are shown in block diagram form.

The foregoing description provides exemplary embodiments only, and is not intended to limit the scope, applicability, or configuration of the disclosure. Rather, the foregoing description of various embodiments will provide an enabling disclosure for implementing at least one embodiment. It should be understood that various changes may be made in the function and arrangement of elements without departing from the spirit and scope of some embodiments as set forth in the appended claims.

Specific details are given in the foregoing description to provide a thorough understanding of the embodiments. However, it will be understood that the embodiments may be practiced without these specific details. For example, circuits, systems, networks, processes, and other components may have been shown as components in block diagram form in order not to obscure the embodiments in unnecessary detail. In other instances, well-known circuits, processes, algorithms, structures, and techniques may have been shown without unnecessary detail in order to avoid obscuring the embodiments.

Also, it is noted that individual embodiments may have been described as a process which is depicted as a flowchart, a flow diagram, a data flow diagram, a structure diagram, or a block diagram. Although a flowchart may have described the operations as a sequential process, many of the operations can be performed in parallel or concurrently. In addition, the order of the operations may be re-arranged. A process is terminated when its operations are completed, but could have additional steps not included in a figure. A process may correspond to a method, a function, a procedure, a subroutine, a subprogram, etc. When a process corresponds to a function, its termination can correspond to a return of the function to the calling function or the main function.

The term "computer-readable medium" includes, but is not limited to portable or fixed storage devices, optical storage devices, wireless channels and various other mediums capable of storing, containing, or carrying instruction(s) and/or data. A code segment or machine-executable instructions may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc., may be passed, forwarded, or transmitted via any suitable means including memory sharing, message passing, token passing, network transmission, etc.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

In the preceding description, for the purposes of explanation, numerous details have been set forth to provide an understanding of various embodiments of the present technology. It will be apparent to one skilled in the art, however, that certain embodiments may be practiced without some of these details, or with additional details. For example, other substrates that may benefit from the wetting techniques described may also be used with the present technology.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included. Where multiple values are provided in a list, any range encompassing or based on any of those values is similarly specifically disclosed.

As used herein and in the appended claims, the singular forms "a", "an", and "the" include plural references unless the context clearly dictates otherwise. Thus, for example, reference to "a metal ion" includes a plurality of such ions, and reference to "the period of time" includes reference to one or more periods of time and equivalents thereof known to those skilled in the art, and so forth.

Additionally, for the purposes of illustration, methods were described in a particular order. It should be appreciated that in alternate embodiments, the methods may be performed in a different order than that described. It should also be appreciated that the methods described above may be performed by hardware components or may be embodied in sequences of machine-executable instructions, which may be used to cause a machine, such as a general-purpose or special-purpose processor or logic circuits programmed with the instructions to perform the methods. These machine-executable instructions may be stored on one or more machine readable mediums, such as CD-ROMs or other type of optical disks, floppy diskettes, ROMs, RAMS, EPROMS, EEPROMs, magnetic or optical cards, flash memory, or other types of machine-readable mediums suitable for storing electronic instructions. Alternatively, the methods may be performed by a combination of hardware and software.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. An electrochemical deposition system comprising:

a bath vessel operable to hold an electrochemical deposition fluid comprising a metal salt dissolved in water, wherein the metal salt comprises copper sulfate, copper methanesulfonate, a nickel salt, a gold salt, or a combination thereof;

a thermometer operable to measure a temperature of the electrochemical deposition fluid;

a concentration sensor operable to measure a concentration of the metal salt in the electrochemical deposition fluid; and a computer configured to perform operations comprising:

receiving system data from the electrochemical system during an electrochemical deposition process, wherein the system data comprises temperature data from the thermometer and metal salt concentration data from the concentration sensor in the electrochemical deposition fluid after the electrochemical deposition fluid has undergone a variation in one or more conditions, wherein the one or more conditions comprise a variation in temperature, a variation in fluid level, a variation in acid concentration, a variation in metal salt concentration, or a combination thereof;

generating from the system data an actual metal salt concentration in the electrochemical deposition fluid and a theoretical solubility limit for the metal salt in the electrochemical deposition fluid that has undergone the variation in one or more conditions, wherein the theoretical solubility limit is calculated during the electrochemical deposition process based at least in part on the temperature data;

comparing the actual metal salt concentration to the theoretical solubility limit for the metal salt in the electrochemical deposition fluid; and generating a control signal to change the temperature of the electrochemical deposition fluid in the bath vessel such that the actual metal salt concentration is adjusted to 50% to 90% of the theoretical solubility limit, wherein the control signal depends on a comparison of the actual metal salt concentration to the theoretical solubility limit for the metal salt in the electrochemical deposition fluid.

2. The electrochemical deposition system of claim 1, wherein the system further comprises an acid concentration sensor operable to measure an acid concentration in the electrochemical deposition fluid, and wherein the system data further comprises acid concentration data from the acid concentration sensor, wherein the theoretical solubility limit is further calculated during the electrochemical deposition process based at least in part on the acid concentration data.

3. The electrochemical deposition system of claim 1, wherein the system further comprises a level sensor operable to measure an amount of the electrochemical deposition fluid in the bath vessel, and wherein the system data further comprises electrochemical deposition fluid level data from the level sensor, wherein the theoretical solubility limit is further calculated during the electrochemical deposition process based at least in part on the deposition fluid level data.

4. The electrochemical deposition system of claim 1, wherein the system further comprises a heater and pump that are operable to heat and circulate the electrochemical deposition fluid in the bath vessel; and a first power sensor operable sense if the heater is heating the electrochemical deposition fluid and a second power sensor operable to sense if the pump is circuiting the electrochemical deposition fluid, wherein the first power sensor and the second power sensor provide system power data to the computer.

5. The electrochemical deposition system of claim 4, wherein the control signal generated by the computer comprises a drain signal to remove the electrochemical deposition fluid from the bath vessel based on the system power data.

6. The electrochemical deposition system of claim 1, wherein the system further comprises a source of deionized water operable to be added to the bath vessel to reduce the actual metal salt concentration in the electrochemical deposition fluid, and wherein the control signal generated by the computer further comprises a dilution signal to add a portion of the source of the deionized water to the bath vessel to reduce the actual metal salt concentration in the electrochemical deposition fluid.

7. The electrochemical deposition system of claim 1, wherein the computer further calculates the theoretical solubility limit for the metal salt in the electrochemical deposition fluid during the electrochemical deposition process based at least in part on a solubility constant of the metal salt in water.

* * * * *